US005278346A

United States Patent [19]

Yamaguchi

[11] Patent Number: 5,278,346

[45] Date of Patent: Jan. 11, 1994

[54] ELECTRONIC MUSIC INSTRUMENT FOR SHIFTING TONE PITCHES OF INPUT VOICE ACCORDING TO PROGRAMMED MELODY NOTE DATA

[75] Inventor: Masafumi Yamaguchi, Hamamatsu, Japan

[73] Assignee: Kabushiki Kaisha Kawai Gakki Seisakusho, Shizuoka, Japan

[21] Appl. No.: 854,906

[22] Filed: Mar. 20, 1992

[30] Foreign Application Priority Data

Mar. 22, 1991 [JP] Japan ..... 3-83475

[51] Int. Cl.[5] ..... G10H 1/00

[52] U.S. Cl. ..... 84/609; 84/723

[58] Field of Search ..... 84/609, 616, 619, 626, 84/628, 629, 631, DIG.

[56] References Cited

U.S. PATENT DOCUMENTS 4,313,361 2/1982 Deutsch ..... 84/616
4,981,457 1/1991 Iimura et al. ..... 84/609 X
5,170,003 12/1992 Kawashima ..... 84/626 X

*Primary Examiner*—Stanley J. Witkowski

[57] ABSTRACT

This invention discloses an electronic musical instrument, which shifts the tone pitches of a series of externally input voice signals in real time, and outputs the shifted voice signals from a loudspeaker. Data for shifting the tone pitches of voice signals is pre-programmed in a memory circuit as music piece data. Every time a user operates an operation switch, the music piece data is sequentially read out, and the tone pitches of voice signals input from a microphone are shifted by a tone pitch converter. The shifted voice signals are output from a loudspeaker in real time. The input voice signals can be shifted to a melody corresponding to the music piece data.

12 Claims, 4 Drawing Sheets

ELECTRONIC MUSIC INSTRUMENT FOR SHIFTING TONE PITCHES OF INPUT VOICE ACCORDING TO PROGRAMMED MELODY NOTE DATA

BACKGROUND OF THE INVENTION

1. Field of the Invention

The present invention relates to an electronic musical instrument and, more particularly, to an electronic musical instrument, which shifts and outputs the tone pitches of externally input voice signals in real time.

2. Description of the Prior Art

Electronic toys, which shift and output the tone pitches of voice signals externally input through a microphone, are known.

FIG. 5 is a block diagram showing a general arrangement of an electric musical instrument having a conventional tone pitch conversion function. As can be seen from the block diagram of FIG. 5, the electronic musical instrument converts an externally input voice into a voice signal $S_{20}$ through a microphone 20, and supplies the converted signal to a pitch converter 21.

The pitch converter 21 receives a signal $S_{21}$ for controlling the tone pitch of the voice signal $S_{20}$ from a pitch shift control circuit 22. The pitch shift control circuit 22 is provided with an operation switch, which can be operated by a user to control the tone pitch of the input voice. The operation switch comprises, e.g., a push-button switch. Every time the user operates the operation switch, the content of the pitch control signal $S_{21}$ to be supplied to the pitch converter 21 is shifted by one step. For example, every time the operation switch is operated, the shift width of the tone pitch of the voice signal $S_{20}$ is increased or decreased by a semitone interval.

The pitch converter 21 shifts the tone pitch of the voice signal $S_{20}$ according to the content of the input pitch control signal $S_{21}$ to generate a pitch-converted voice signal $S_{22}$, and supplies the signal $S_{22}$ to an amplifier 23. The pitch-converted voice signal $S_{22}$ supplied to the amplifier 23 is amplified to a predetermined level, and the amplified signal is externally produced as a tone through a loudspeaker 24.

The conventional electronic musical instrument shifts the tone pitch of the voice signal $S_{20}$ every time the user operates the switch of the pitch shift control circuit 22. For this reason, the shift width of the tone pitch, which can be shifted by a single operation, is limited.

More specifically, as described above, the tone pitch of the voice signal $S_{20}$ is shifted by a semitone interval every time the operation switch is depressed once. Thus, a pitch shift operation for instantaneously shifting the tone pitch by, e.g., three tone intervals cannot be performed. For this reason, the conventional function is used for simply shifting the tone pitch, and it is difficult to use this function together with several other of musical factors.

SUMMARY OF THE INVENTION

The present invention has been made in consideration of the above situation, and has as its object to provide an electronic musical instrument, which can desirably shift the tone pitch of an externally input voice signal.

An electronic musical instrument according to the present invention comprises a microphone for converting an externally input voice into an electrical signal, a memory circuit for storing a series of pitch shift data for shifting the tone pitch of the external input voice signal output from the microphone, a data readout circuit for sequentially reading out the pitch shift data from the memory circuit every time operation switch means is operated, and a tone pitch converter for shifting the tone pitch of the voice signal supplied from the microphone on the basis of the pitch shift data supplied from the memory circuit, and outputting the shifted voice signal.

Data for shifting the tone pitch of a voice signal is stored in the memory circuit as music piece data, and is read out according to an operation by a user so as to shift the tone pitch of the externally input voice signal. The music piece data can be programmed to obtain a corresponding melody.

DESCRIPTION OF THE PREFERRED EMBODIMENT

Figure 1:
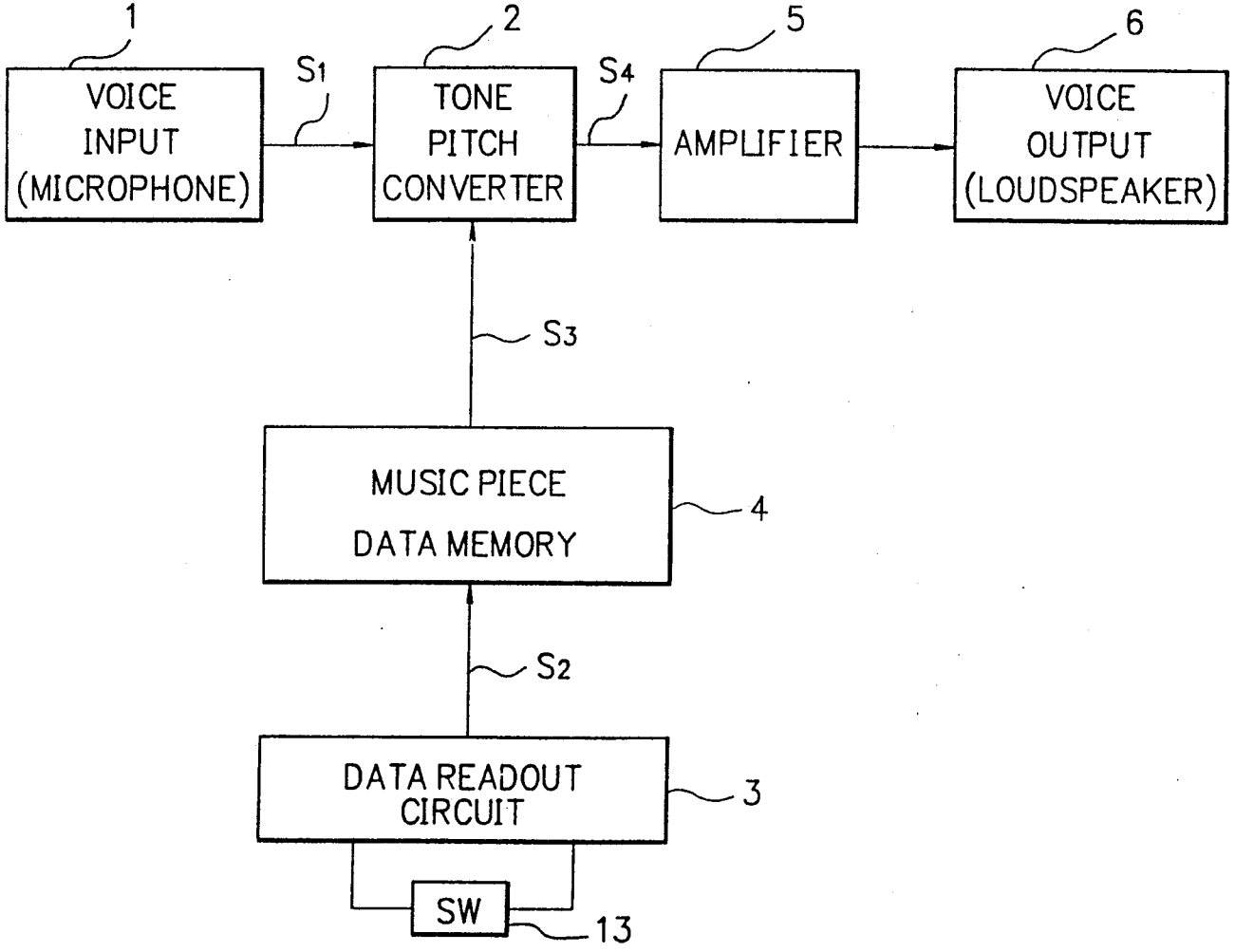
FIG. 1 is a block diagram showing an electronic musical instrument according to an embodiment of the present invention.
Figure 2:
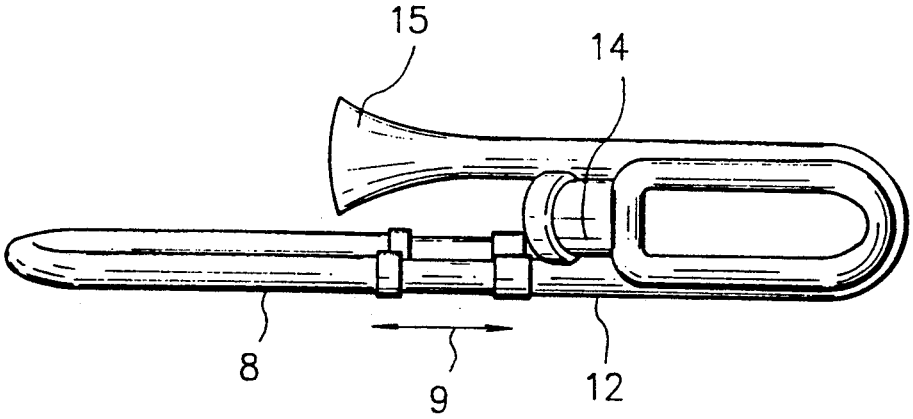
FIG. 2 is a side view showing an example of the electronic musical instrument.

FIG. 1 is a block diagram showing principal part of an electronic musical instrument according to an embodiment of the present invention, and FIG. 2 is a side view showing the outer appearance of the electronic musical instrument. A mouthpiece portion 14 of a trombone-like electronic musical instrument shown in FIG. 2 incorporates a microphone, and a bell portion 15 incorporates a loudspeaker.

In FIG. 1, an externally input voice is converted into a voice signal $S_1$ by a microphone 1, and the signal $S_1$ is supplied to a tone pitch converter 2.

When a movable portion 8 corresponding to a hand slide of the electronic musical instrument main body is moved in a direction of an arrow 9 in FIG. 2, a data readout circuit 3 is enabled, and supplies a data readout signal $S_2$ to a music piece data memory 4.

Figure 3A:
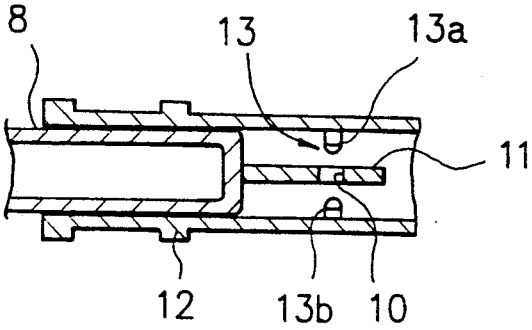
FIG. 3A is a sectional view showing a switch for enabling a data readout circuit.
Figure 3B:
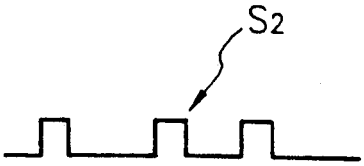
FIG. 3B is a waveform chart showing the output from the switch.

A switch for enabling the data readout circuit 3 as shown in FIG. 3A. More specifically, a tongue 11 is attached to the distal end of the movable portion 8, and a detection hole 10 is formed in the tongue 11. A photosensor (switch) 13 consisting of a light-emitting element **13*a* and a light-receiving element 13*b* is arranged on a stationary support pipe 12, in which the movable portion 8 is slidably fitted. When the movable portion 8 is moved, the movement of the detection hole 10 is detected by the photosensor 13, and a pulse signal shown in the waveform chart of FIG. 3B** is output as the data readout signal $S_2$.

The music piece data memory 4 stores data for determining the pitch shift width of the input voice signal $S_1$. When the data readout signal $S_2$ is supplied to the memory 4 upon movement of the movable portion 8, music piece data $S_3$ for one music piece is read out tone by tone, and is supplied to the tone pitch converter 2.

The music piece data is data constituted by arranging a series of tone pitch data, each of which expresses a note of a tone by one byte, in correspondence with a melody of a music piece. The series of data between the top and end addresses are registered as one unit of data, i.e., music piece data for one music piece.

The tone pitch converter 2 performs processing for shifting the tone pitch of the input voice signal $S_1$ on the basis of the music piece data $S_3$ supplied from the music piece data memory 4 in real time. Thus, the tone pitch of a voice externally input through the microphone 1 is shifted. The pitch-shifted voice signal $S_4$ is supplied to and amplified by an amplifier 5, and the amplified signal is externally produced as a tone through a loudspeaker 6. In this case, the volume of a tone produced from the loudspeaker 6 is proportional to the tone volume input to the microphone.

Figure 4:
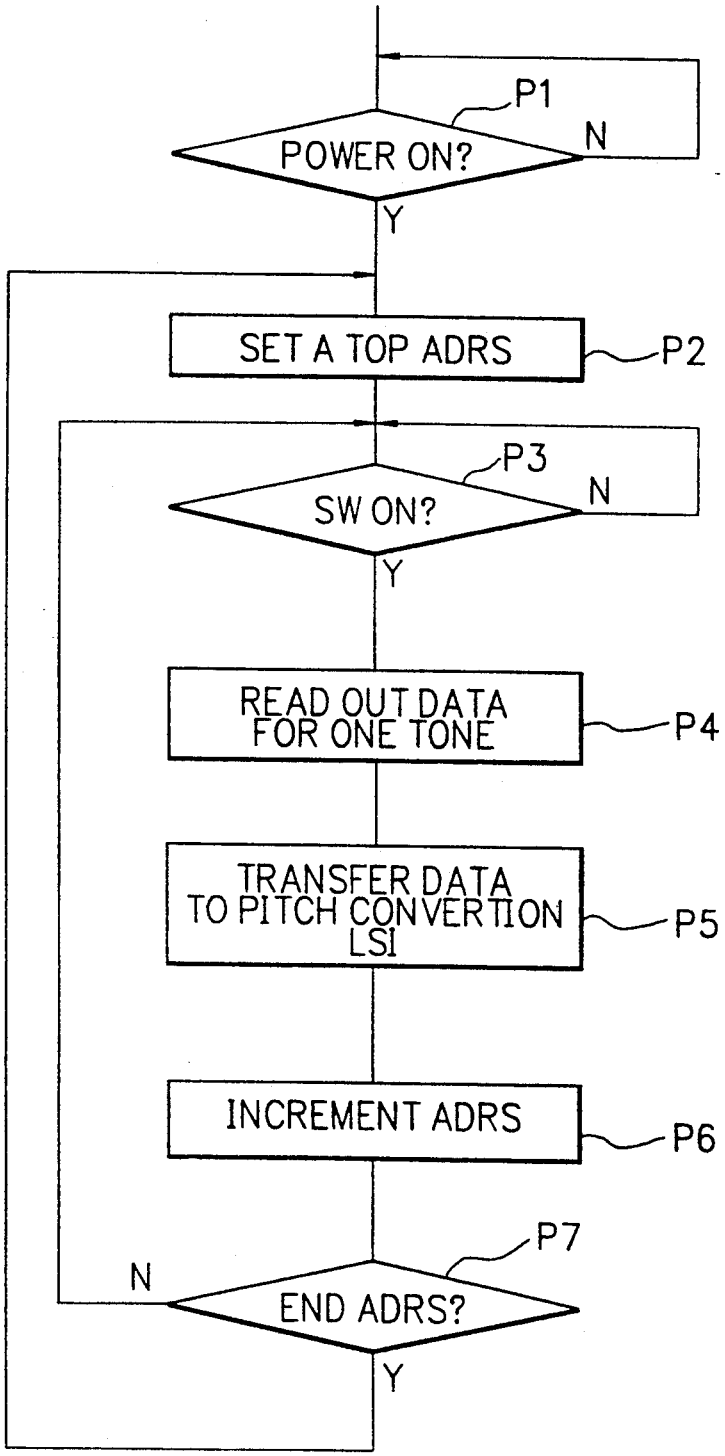
FIG. 4 is a flow chart for explaining a tone pitch conversion operation.
Figure 5:
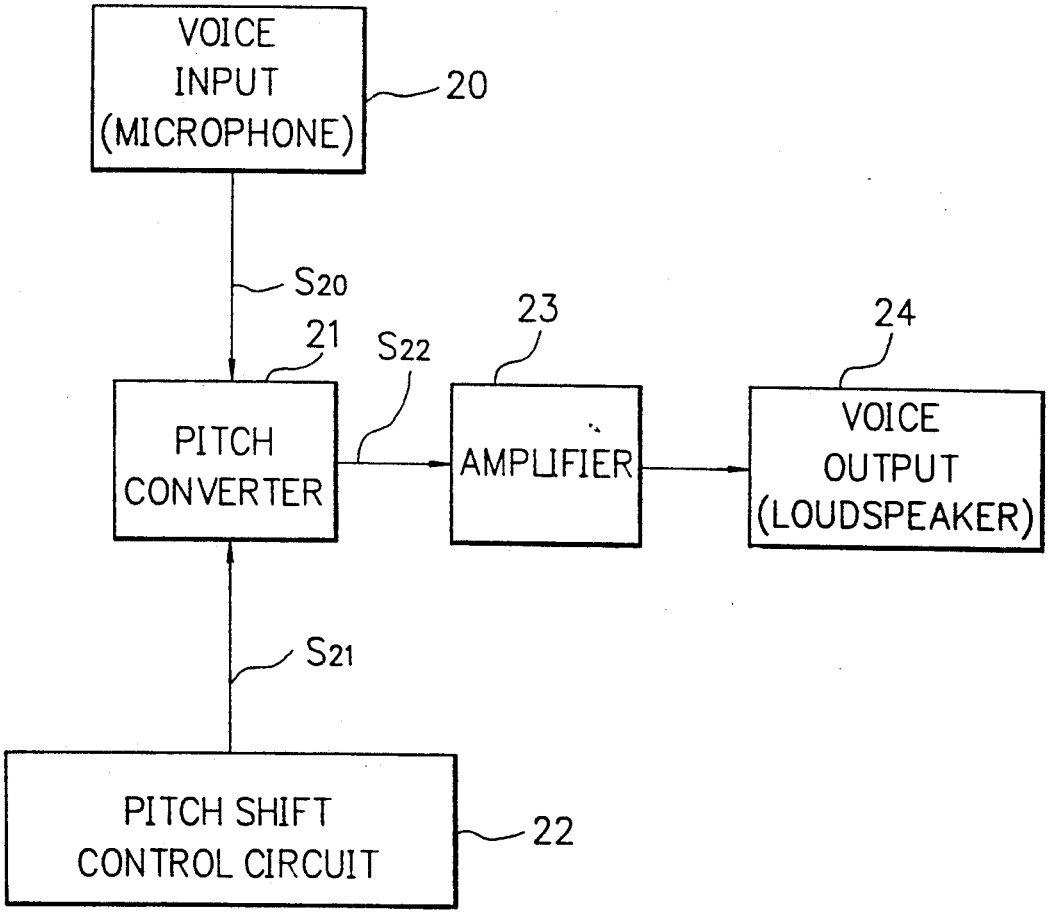
FIG. 5 (Prior Art)
FIG. 5 is a block diagram showing a conventional electronic musical instrument.

The tone pitch conversion operation of the electronic musical instrument according to this embodiment will be described below with reference to the flow chart shown in FIG. 4.

It is checked in step P1 if a power switch is turned on. This decision step is repeated until the power switch is turned on. If Y (YES) in step P1, the flow advances to step P2. In step P2, the top address of music piece data is set.

It is then checked in step P3 if a switch 13 is turned on. If it is determined in step P3 that the switch 13 is ON, the flow advances to step P4, and data for one tone is read out from the music piece data memory 4. In step P5, the readout data is supplied to the tone pitch converter 2.

Upon reception of the music piece data, the tone pitch converter 2 performs a tone pitch shift operation of the voice signal $S_1$. In step P6, every time the tone pitch shift operation of one tone is performed, the read address of the music piece data is incremented by one. In step P7, it is checked if the read address of the music piece data has reached the end address.

If N (NO) in step P7, the flow returns to step P3, and the tone pitch shift operation is continued. However, if Y in step P7, the flow returns to step P2 to set the top address.

Since the electronic musical instrument of this embodiment shifts the tone pitch of an externally input voice in this manner, an externally input simple voice produced from, e.g., a mouth of a person can be desirably shifted across a plurality of scales. For example, when an unaccentuated voice such as "A, B, C, . . . " or "Uh, . . . " is input from the microphone 1, a voice obtained by converting the input voice into a melody can be produced from the loudspeaker 6. Therefore, not only a user can enjoy a simple shift operation of the tone pitch, but also he or she can shift the tone pitch in consideration of various musical factors, thus providing various effects when he or she performs the tone pitch shift operation of the externally input voice.

Note that the memory 4 can store a plurality of kinds of music piece data. In this case, a music piece selection switch is provided to the instrument main body. Music piece data may be stored in a storage medium such as a ROM card to obtain a large number of music pieces by exchanging the cards.

According to the present invention, as described above, data for shifting the tone pitch of a voice signal is stored in advance in a memory circuit as music piece data. When a user's operation is made, the music piece data is read out, and is used as pitch shift data for shifting the tone pitch of the voice. For this reason, the pitch shift width can be desirably set. Therefore, when a user performs a tone pitch shift operation of an externally input voice, he or she can do it in consideration of various musical factors, and fun of the pitch shift operation can be greatly improved.

What is claimed is:

1. An electronic musical instrument comprising:

a microphone for converting an externally input voice into an electrical signal;

a memory circuit for storing a series of pitch shift data for shifting a tone pitch of the externally input voice signal output from said microphone;

a data readout circuit for sequentially reading out the series of pitch shift data from said memory circuit every time an operation switch means is operated; and tone pitch converting means for shifting the tone pitch of the externally input voice signal supplied from said microphone on the basis of the series of pitch shift data supplied from said memory circuit, and outputting the shifted externally input voice signal.

2. The electronic musical instrument of claim 1, wherein the series of pitch shift data is note data representing a melody of a music piece.

3. The electronic musical instrument of claim 1, wherein said operation switch means imitates an operation member of an acoustic instrument.

4. The electronic musical instrument of claim 1, wherein said tone pitch converting means shifts the tone pitch of the external input voice signal in real time.

5. The electronic musical instrument claim 1, wherein said electronic musical instrument has a wind instrument shape, said microphone being incorporated in a mouthpiece portion of said electronic musical instrument, and a loudspeaker is incorporated in a bell portion of said electronic musical instrument.

6. The electronic musical instrument according to claim 1, wherein said electronic musical instrument has a trombone shape, and said operation switch means is assembled in a hand slide of the trombone.

7. A method of controlling a pitch of an externally input voice, comprising the steps of:

(a) converting the externally input voice to an input voice signal;

(b) determining if an operation switch of an electronic musical instrument has been activated;

(c) reading music piece data from a memory when the operation switch is activated in said step (b);

(d) shifting the pitch of the input voice signal according to the music piece data read in said step (c); and (e) outputting the shifted input voice signal.

8. The method of claim 7, wherein the music piece data is a melody of a music piece.

9. The method of claim 7, wherein the operation switch is an operation member of an acoustic instrument.

10. The method of claim 7, wherein said step (d) is performed in real time.

11. The method of claim 7, wherein the electronic musical instrument is a wind instrument including a microphone in a mouthpiece portion and a loudspeaker in a bell portion.

12. The method of claim 7, wherein the electronic musical instrument is a trombone and a hand slide portion of the trombone includes the operation switch.

* * * * *